United States Patent [19]

Mergler

[11] Patent Number: 4,971,142

[45] Date of Patent: Nov. 20, 1990

[54] HEAT EXCHANGER AND HEAT PIPE THEREFOR

[75] Inventor: Thomas G. Mergler, Bolivar, N.Y.

[73] Assignee: The Air Preheater Company, Inc., Wellsville, N.Y.

[21] Appl. No.: 292,964

[22] Filed: Jan. 3, 1989

[51] Int. Cl.[5] ..... F28D 15/02

[52] U.S. Cl. ..... 165/104.14; 165/133; 165/134.1; 165/913; 29/890.032

[58] Field of Search ..... 165/104.21, 134.1, 905, 165/133, 913, 104.14; 29/890.032

[56] References Cited

U.S. PATENT DOCUMENTS

| | | | |
|---|---|---|---|
| 2,096,250 | 10/1937 | Kasarjian | 165/104.21 |
| 2,813,698 | 11/1957 | Lincoln | 165/104.21 |

FOREIGN PATENT DOCUMENTS

| | | | |
|---|---|---|---|
| 155191 | 12/1980 | Japan | 165/104.14 |
| 2984 | 1/1982 | Japan | 165/104.14 |
| 212825 | 12/1983 | Japan | 104.14/ |

*Primary Examiner*—Albert W. Davis, Jr.
*Attorney, Agent, or Firm*—Richard H. Berneike

[57] ABSTRACT

A heat pipe is formed of two elongated tubular members each having an open end and a closed end and joined at their open ends in gas-tight relationship by means of an annular collar. The annular collar is adapted at one end to fit over the open end of one of the elongated tubular members and at its other end to fit over the open end of other of the elongated tubular members, with the ends of the annular collar being sealably secured, such as by welding, bonding, threading or otherwise, to their respective tubular members thereby providing a gas-tight enclosure within the interconnected tubular which constitutes the working chamber of the heat pipe. Advantageously, the two elongated tubular members may be formed of dissimilar materials. For example, one tubular member may be formed of a more expensive material having a relatively high corrosion resistance and the other tubular member may be formed of a less expensive material having a relatively low corrosion resistance.

7 Claims, 1 Drawing Sheet

HEAT EXCHANGER AND HEAT PIPE THEREFOR

BACKGROUND OF THE INVENTION

The present invention relates generally to heat exchangers for transferring heat from a gaseous heating fluid to a gaseous fluid to be heated and, more particularly, to such a gas to gas heat exchanger incorporating therein heat pipes, each heat pipe defining a working chamber having an evaporator section disposed in the flow path of the gaseous heating fluid and a condensor section disposed in the flow path of the gaseous fluid to be heated, and housing a working fluid which continuously undergoes a phase change as it circulates between the evaporator and condensor sections of the working chamber.

Heat exchangers incorporating numerous independently operating heat pipes to transfer heat from a hot gas stream to a cool gas stream have found wide application in industry. For example, in U.S. Pat. No. 2,813,698, heat pipes are used in a heat exchanger to preheat combustion air by transferring heat from the hot stack gas discharged from a furnace to combustion air being supplied to the furnace. Further, U.S. Pat. Nos. 4,616,697 and 4,687,649 disclose using heat pipe heat exchangers to reheat stack gas discharged from a wet scrubber by transferring heat from the hot stack gas upstream of the scrubber to the cool stack gas downstream of the scrubber.

In such heat exchangers, each heat pipe operates independently and consists of an elongated, closed tube which has been evacuated, filled with a heat transfer fluid, and hermetically sealed. Although many different heat transfer fluids have been successfully used as the working fluid in heat pipes, water is generally used as the working fluid in most industrial applications such as air preheating and flue gas reheating due to its low cost, ease of handling, safety and suitable heat transfer characteristics in the applicable range of operating temperatures for such application. In operation, the evaporator section of the heat pipe is disposed in the hot gas stream such that thermal energy is transferred from the hot gases to vaporize working fluid in the evaporator section. The vapor travels to the condensor section which is disposed in the gas stream be heated where the cool gas flowing over the heat pipe removes heat from the vapor causing the vapor to condense into liquid which flows back to the evaporator section of the heat pipe where it will be vaporized again by the hot flue gases. The closed loop evaporation-condensation cycle is continuous as long as there is a temperature difference between the combustion air or scrubber discharge gas to be heated and the flue gas serving as the heating fluid.

When used in heat exchangers for air preheating, flue gas reheating, and many other industrial gas to gas heat transfer applications, heat pipes are exposed to gas temperatures ranging from a low of about ambient temperature for the gas to be heated, to a typical high of about 150 C. to 200 C. for the heating gas, while the operating temperature of the heat pipes per se typically ranges from about 70 C. to about 130 C. depending from a heat pipes location within the heat exchanger with respect to the incoming flow of heating gas.

In any case, a problem generally experienced when using heat pipes to preheat combustion air or reheat flue gas via heat transfer from hot flue gas is that condensation of corrosive gases in the flue gas occurs when the flue gas temperature drops below the adiabatic saturation temperature of the flue gas. In combustion air preheat applications, condensation of corrosive gases usually occurs on the exterior surface of the evaporator portion of the heat pipes disposed in the flue gas flow at the cold end of the heat exchanger. However, as no corrosive gases are present in the combustion air being preheated, the condensor portions of these same heat pipes will not be exposed to corrosion. In flue gas reheat applications, the condensation of corrosive gases is usually experienced on the exterior surface of the condensor portion of the heat pipes disposed in the cold end of the heat exchanger in the flow of cool moisture-saturated flue gas discharged from the flue gas scrubber. However, as the hot flue gas serving as the heating gas in such flue gas reheat applications typically exits the heat exchanger at a temperature well above the saturation point, the evaporator portions of these same heat pipes will not be exposed to corrosion.

In conventional practice, it is customary to manufacture a heat pipe that is to be installed in the cold end of such a heat exchanger completely out of a highly corrosion resistant material having adequate strength properties, such as corrosion resistant steel alloys, or to coat the entire heat pipe with a layer or enamel of a corrosion resistant alloy or metal or plastic polymer. Although such a practice is indeed effective to protect the heat pipes installed in the cold end of such a heat exchanger against corrosion, it is an expensive practice as the entire heat pipe is customarily so treated even though only one portion of the heat pipe is actually ever exposed to corrosive elements.

Accordingly, in is an object of the present invention to provide a heat pipe which is manufactured from two separate tubular members, one of which may be produced from a material having relatively high corrosion resistance or from a material coated with a layer of corrosion resistant material, while the other portion may be produced from a less expensive material having relatively low corrosion resistance.

SUMMARY OF THE INVENTION

The heat pipe of the present invention is formed of a first elongated tubular member manufactured from a first material connected end to end in sealed relationship to a second elongated tubular member manufactured from a second material, which may advantageously be dissimilar to the first material from which the first elongated tubular member is manufactured, so as to provide an elongated tubular enclosure defining the working chamber of the heat pipe. Each of the first and second tubular members have one open end and one closed end.

In the preferred embodiment, the open ends of the two tubular members are connected by means of an annular collar having first and second axially spaced open ends and adapted at its first end to receive the open end of the first elongated tubular member and at its second end to receive the open end of the second elongated tubular. Once the open ends of the two tubular members are inserted from opposite ends into the annular collar, the ends of the annular collar are each secured to the respective tubular member received therein so as to provide a gas tight seal. Depending upon the material from which the tubular member received by an end of the collar is made, that end of the annular collar may be either welded about its entire circumference, such as by a butt weld or a fillet weld, to the received tubular member, or bonded about its entire circumference by epoxy cement, glue or otherwise to the received tubular member, or threaded about the open end of the received tubular. In the event that either or both of the tubular members are threaded into the annular collar, a seal ring may be disposed within the annular collar in abutting relationship with and intermediate the ends of the tubular members received within the annular collar.

DESCRIPTION OF THE PREFERRED EMBODIMENT

Figure 1:
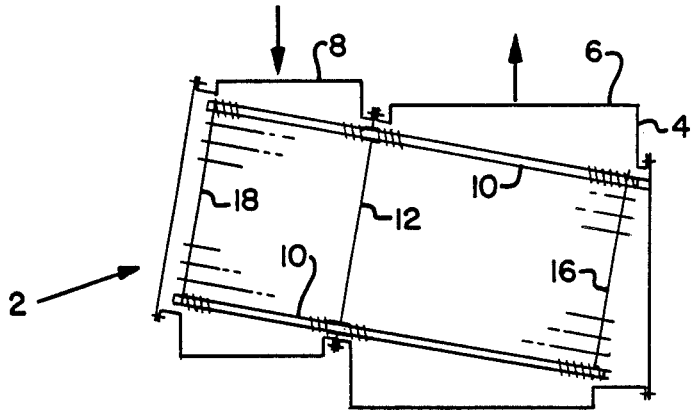
FIG. 1 is an side elevational view, partly in section, of a gas to gas heat exchanger incorporating a plurality of the heat pipes of the present invention.

Referring now to the drawing, and more particularly to FIG. 1 thereof, there is depicted therein a gas to gas heat exchanger 2 comprising a casing 4 defining within its interior a first gas duct 6 providing a flow passageway for a stream of gaseous heating fluid to pass therethrough and a second gas duct 8 providing a flow passageway for a stream of gaseous fluid to be heated to pass therethrough, and a plurality of heat pipes 10 disposed within the casing 4 and supported in and extending through a seal plate 12 mounted within the casing 4 so as to divide the casing 4 into the first gas duct 6 on one side of the seal plate 12 and the second gas duct 8 on the other side of the seal plate 12.

Figure 2:
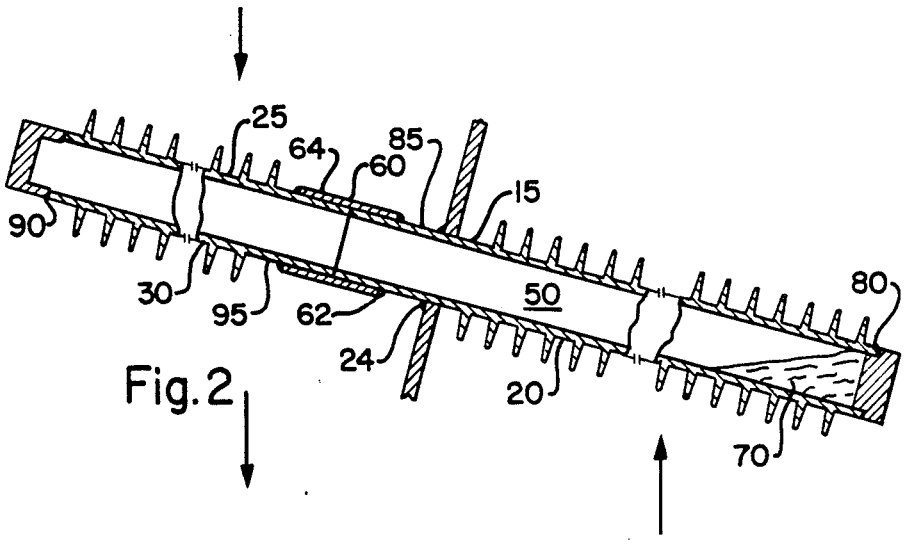
FIG. 2 is a cross-sectional side elevational view of an embodiment of the heat pipe of the present invention comprising two tubular members connected in sealed relationship by means of an annular collar.
Figure 3:
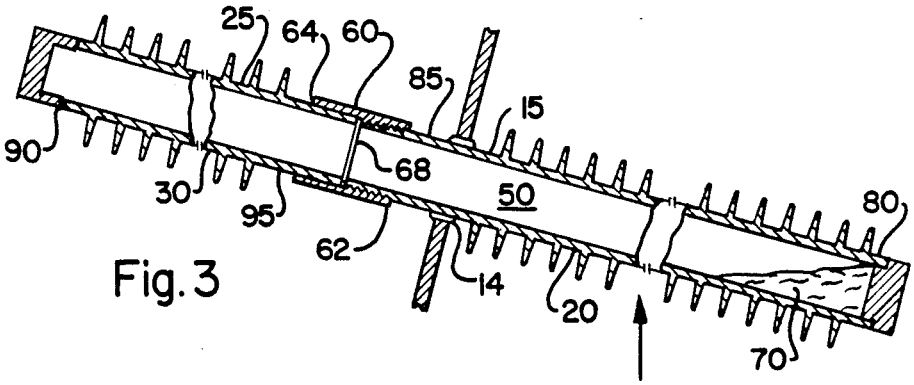
FIG. 3 is a cross-sectional side elevational view of an alternate embodiment of the heat pipe of the present invention comprising two tubular members connected in sealed relationship by means of an annular collar.

The seal plate 12 serves not only as a partition plate to separate the flow passageways for the heating gas and the gas to be heated from each other to preclude intermixing of the fluids, but also as a tube sheet for supporting the heat pipes 10. Each heat pipe 10 is mounted in a hole in the seal plate 12 so as to penetrate the seal plate 12 and extend therethrough into the first gas duct 6 on one side of the seal plate 12 and into the second gas duct 8 on the other side of the seal plate 12. The heat pipes 10 are tightly fitted into the seal plate 12, preferably with a sealing ring 14 disposed between each heat pipe 10 and the surrounding edge of the hole into which it is fitted as best seen in FIG. 2, or with a circumferential seal weld 24 as best seen in FIG. 3, so as provide a gas tight fit to preclude leakage of gas from one gas duct to the other. Alternatively, more elaborate thermal sleeve type support members, such as shown in U.S. Pat. Nos. 4,485,865 and 4,674,567, or German Offenlegungsschrift No. 2920577, may be employed to mount the heat pipes 10 into the seal plate 12. In any case, the outer ends of the heat pipes 10 may be supported in support plates 16 and 18 disposed at opposite sides within the heat exchanger casing 4 to provide additional support for the heat pipes to preclude the ends of the heat pipes from saging and permit unrestrained thermal expansion of the heat pipes.

The heat pipes 10 comprise an enlongated tubular enclosure defining within its interior a closed working chamber 50 which contains a working fluid 70 which is not only evaporable within the temperature range provided by the heating gas, but also condensible within the temperature range provided by the gas to be heated. The portion 20 of the heat pipe 10 which extends through the seal plate 12 into the heating gas duct 6 serves as the evaporator section of the heat pipe 10, while the portion 30 of the heat pipe 10 which extends through the seal plate 12 into the duct 8 for the gas to be heated serves as the condensor section of the heat pipe 10. Each heat pipe 10 is installed at slight tilt within the heat exchanger 2 with its evaporator section, that is the section disposed in the heating gas stream, lower than its condensor section, that is the section disposed in the gas stream to be heated, so as to assist the return flow of the working fluid from the condensor section to the evaporator section. Typically, the heat pipes are installed at an angle of a few degrees, generally about 5 to 15 degrees, with the horizontal by installing the seal plate 12 within the casing 4 at a similar angle to the vertical and mounting the heat pipes to extend through the seal plate 12 substantially perpendicularly thereto.

In accordance with the present invention, each heat pipe 10 comprises a first elongated tubular member 15, manufactured from a first material, and connected end to end in sealed relationship to a second elongated tubular member 25 manufactured from a second material, which may advantageously be dissimilar to the first material from which the first elongated tubular member 15 is manufactured, so as to provide an elongated tubular enclosure defining the working chamber 50 of the heat pipe 10. Each of the first and second tubular members 15,25 have respectively one open end 85,95 and one closed end 80,90 as best seen in FIGS. 2 and 3.

In the preferred embodiment, the open ends 85,95 of the two tubular members 15,25 are connected by means of an annular collar 60 having first open end 62 and second open end 64 axially spaced from the first open end 62. The annular collar 60 is adapted at its first open end 62 to receive the open end 85 of the first elongated tubular member 15 and at its second open end 64 to receive the open end 95 of the second elongated tubular 25. Once the open ends of the two tubular members 15,25 are inserted from opposite ends into the annular collar 60, the ends 62 and 64 of the annular collar are each secured respectively to the tubular members 15 and 25 received therein so as to provide a gas tight seal.

Depending upon the material from which the tubular member received by an end of the collar 60 is made, that end of the annular collar may, as shown in FIG. 2, be either welded about its entire circumference, such as by a butt weld or a fillet weld, to the received tubular member, or bonded about its entire circumference by epoxy cement, glue or otherwise to the received tubular member, or as shown in FIG. 3 threaded about the open end of the received tubular In the event that either or both of the tubular members 15 and 25 are threaded into the annular collar 60 as shown in FIG. 3, a seal ring 68 may be disposed within the annular collar 60 in abutting relationship with and intermediate the ends 85 and 95 of the tubular members received within the annular collar.

For example, the first tubular member 15 could be manufactured from a relatively strong, highly corrosion resistant steel alloy such as low carbon stainless steel, for example ASTM (American Society of Testing and Materials) A588 stainless steel, while the second tubular member 25 would be manufactured from a less expensive, high strength but relatively low corrosion resistance steel alloy such as carbon steels, for example ASTM A178 carbon steel. With such a heat pipe, the annular collar 60 would be welded as hereinbefore noted at one end to the stainless steel first tubular member 15 and at its other end to the carbon steel second tubular member 25. The heat pipe so constructed would be installed in the heat exchanger with its corrosion resistant first tubular member disposed in the flow path of the corrosive gas stream, while the low corrosion resistant second tubular member 25 would be disposed in the flow path of the non-corrosive gas stream. The connection of the open end 85 of the first tubular member 15 to the open end 95 of the second tubular member 25 would be located on the side of the seal plate 12 on which the second tubular member 25 is disposed so the annular collar 60 and the welds at its ends would be located in the flow path of the non-corrosive gas stream. So located, the annular collar 60 may be manufactured of low corrosion resistant steel alloy or metal.

Alternatively, the first tubular member 15 could be manufactured from a relatively strong, highly corrosion resistant non-metallic material, for example a polymer plastic material which has acceptable heat transfer characteristics or a glass or ceramic material having acceptable heat transfer characteristics while the second tubular member 25 would be manufactured from a less expensive, high strength but relatively low corrosion resistance steel alloy such as carbon steels, for example ASTM A178 carbon steel. With such a heat pipe, the annular collar 60 would be welded as hereinbefore noted at one end to end to the carbon steel second tubular member 25, but at its other end would be bonded about its circumference, such as with epoxy cement or glue, to the non-metallic first tubular member 15. Alternatively, the end of the annular collar 60 sealed to the non-metallic first tubular member 15 may be threaded to the end of the first tubular member as shown in FIG. 3 by providing suitable external threads on the end 85 of the first tubular member 15 and mating internal threads on the interior of the end 62 of the annular collar 60 receiving the threaded end 85 of the first tubular member 85. In such case, a ring seal member 68 is preferably disposed within the annular collar 60 in abutting relationship with and intermediate the ends 85 and 95 of the tubular members received within the annular collar 60 to ensure a gas tight enclosure.

Again, the heat pipe so constructed would be installed in the heat exchanger with its non-metallic corrosion resistant first tubular member disposed in the flow path of the corrosive gas stream, while the low corrosion resistant second tubular member 25 would be disposed in the flow path of the non-corrosive gas stream. The connection of the open end 85 of the first tubular member 15 to the open end 95 of the second tubular member 25 would be located on the side of the seal plate 12 on which the second tubular member 25 is disposed so the annular collar 60 and the weld at its one end and the bond or threaded connection at its other end would be located in the flow path of the non-corrosive gas stream. So located, the annular collar 60 may be manufactured of low corrosion resistant steel alloy or metal.

As noted previously, when the temperature of the of the gas flowing over the heat pipes drops to a level below the adiabatic saturation temperature of the flue gas, corrosive gases in the flue gas may condense onto the exterior of the heat pipe. When a heat pipe heat exchanger is employed as an air preheater, this condensation of corrosive gases will occur on the evaporator section of the heat pipes disposed in the cold end of the heating gas duct 6. Similarly, when a heat pipe heat exchanger is employed to reheat flue gas, this condensation of corrosive gases will most likely occur on the condensor section of the heat pipes disposed in the cold end of the gas duct 8 for the flue gas being reheated. Through use of the two-piece heat pipes of the present invention, the portion of the heat pipe that is likely to be exposed to the corrosive gases may be manufactured from a material having not only adequate strength properties but also relatively high corrosion resistance, while the remainder of the heat pipe may be constructed of less expensive material having adequate strength properties but relatively low corrosion resistance. Such a construction results in a heat pipe of which has a long operating life, but is less expensive to manufacture.

I claim:

1. A heat pipe heat exchange apparatus comprising:

a. a casing defining within its interior a gas flow path therethrough;

b. a seal plate disposed within the interior of said casing so as to divide the gas flow path therethrough into a first gas duct on one side of the seal plate defining a first flow passageway for a first corrosive gas stream and a second gas duct on the opposite side of the seal plate defining a second flow passageway for a second non-corrosive gas stream; and c. at least one heat pipe apparatus mounted to the seal plate so as to extend therethrough, said at least one heat pipe apparatus comprising: a first elongated tubular member having a closed end disposed within the first gas duct, and an open end disposed within the second gas duct, a second elongated tubular member having a closed end disposed within the second gas duct and an open end disposed within the second gas duct in flow communication with the open end of said first elongated tubular member, and annular collar means having first and second axially spaced open ends and adapted at the first end to receive the open end of said first elongated tubular member and at the second end to receive the open end of said second tubular member, said annular collar being disposed entirely within the second gas duct and secured at the first end to the open end of said first elongated tubular member and being secured at the second end to the open end of said second elongated tubular member, said first elongated tubular member being manufactured from a relatively high corrosion resistance material and said second elongated tubular member being manufactured from a relatively low corrosion resistance material.

2. A heat pipe apparatus as recited in claim 1 wherein said first elongated tubular member is manufactured from a first steel alloy having a relatively high corrosion resistance and said second elongated tubular member is manufactured from a second steel alloy having a relatively low corrosion resistance.

3. A heat pipe apparatus as recited in claim 2 wherein said first steel alloy consists essentially of a stainless steel alloy and said second steel alloy consists essentially of a carbon steel alloy.

4. A heat pipe apparatus as recited in claim 1 wherein said first elongated tubular member is manufactured from a first corrosion resistant material comprising a non-metallic material having a relatively high corrosion resistance and said second elongated tubular member is manufactured from a second material comprising a steel alloy having a relatively low corrosion resistance.

5. A heat pipe apparatus as recited in claim 4 wherein said non-metallic material consists essentially of a polymer plastic material and said second material consists essentially of a carbon steel alloy.

6. A heat pipe apparatus as recited in claim 1 wherein said first elongated tubular member is manufactured from a steel alloy having a relatively low corrosion resistance and having an exterior surface coated with a layer of material having a relatively high corrosion resistance.

7. A heat pipe apparatus as recited in claim 1 further comprising a ring seal disposed within said annular collar in abutting relationship with and intermediate the open end of said first elongated tubular member and the open end of said second elongated tubular member.

* * * * *